US010940518B2

(12) United States Patent
Hayashi et al.

(10) Patent No.: US 10,940,518 B2
(45) Date of Patent: Mar. 9, 2021

(54) MANUFACTURING METHOD FOR PRESS-FORMED ARTICLE

(71) Applicant: FUTABA INDUSTRIAL CO., LTD., Okazaki (JP)

(72) Inventors: Yasuhiro Hayashi, Okazaki (JP); Masatoshi Miwa, Okazaki (JP); Koichi Kume, Okazaki (JP); Masato Sakai, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 170 days.

(21) Appl. No.: 15/990,769

(22) Filed: May 28, 2018

(65) Prior Publication Data

US 2018/0345348 A1 Dec. 6, 2018

(30) Foreign Application Priority Data

May 31, 2017 (JP) ..... JP2017-108205

(51) Int. Cl.
*B21D 24/00* (2006.01)
*B21D 22/02* (2006.01)

(52) U.S. Cl.
CPC ..... *B21D 24/005* (2013.01); *B21D 22/02* (2013.01)

(58) Field of Classification Search
CPC ..... B21D 22/02; B21D 22/21; B21D 24/00; B21D 24/005; B21D 19/08; B21D 13/00; B21D 13/02; B21D 13/08; B21D 13/10; B21D 17/02; B21D 22/027; B21D 22/04; B21D 22/06; B21D 22/26
See application file for complete search history.

(56) References Cited

U.S. PATENT DOCUMENTS

2015/0196950 A1 7/2015 Saito

FOREIGN PATENT DOCUMENTS

| | | | | |
|---|---|---|---|---|
| JP | S5897428 A | | 6/1983 | |
| JP | S61-222640 A | | 10/1986 | |
| JP | 04237523 | * | 8/1992 | ..... B21D 19/08 |
| JP | H04237523 A | | 8/1992 | |
| JP | H07171625 A | | 7/1995 | |
| JP | H11090534 A | | 4/1999 | |
| JP | 4975386 B2 | | 7/2012 | |
| JP | 5380890 B2 | | 1/2014 | |
| JP | 2014-046349 A | | 3/2014 | |

OTHER PUBLICATIONS

Translation—JP-04237523—Takishima—Translated Feb. 11, 2020 (Year: 1991).*
First Office Action for Chinese Patent Application No. 201810536665.2, dated Jul. 26, 2019, 13 pages.
Notice of Reasons for Refusal for Japanese Patent Application No. 2017-108205, dated Jan. 28, 2020, 8 pages including English translation.
Second Office Action for Chinese Patent Application No. 201810536665.2, dated Mar. 30, 2020, 10 pages.

* cited by examiner

*Primary Examiner* — Debra M Sullivan
*Assistant Examiner* — Matthew Kresse
(74) *Attorney, Agent, or Firm* — Withrow & Terranova, P.L.L.C.; Vincent K. Gustafson

(57) ABSTRACT

A manufacturing method of a press-formed article includes: forming a specified shape in a plate-like member made of metal; forming a convex portion in a portion that does not undergo deformation by the forming of the specified shape in the plate-like member; and flattening the convex portion.

5 Claims, 7 Drawing Sheets

MANUFACTURING METHOD FOR PRESS-FORMED ARTICLE

CROSS-REFERENCE TO RELATED APPLICATIONS

The present application claims the benefit of Japanese Patent Application No. 2017-108205 filed on May 31, 2017 with the Japan Patent Office, and the entire disclosure of Japanese Patent Application No. 2017-108205 is hereby incorporated by reference herein.

BACKGROUND

The present disclosure is related to a manufacturing method for a press-formed article.

In a press-formed article released from load of a metal mold after forming, inner stress attributed to elastic recovery phenomenon causes change in a shape, which is springback. Thus, the metal mold is designed in consideration of an amount of the springback. It is preferable that such an amount of the springback be as small as possible.

Japanese Patent No. 5380890 discloses a technology that achieves reduction in an amount of the springback in a portion that undergoes tension deformation due to press-forming by forming a bead in the portion in the first step and flattening the formed bead in the second step. In the portion where the tension deformation occurs by the press-forming, tension stress is caused. When the bead is formed and later flattened in the portion, compression stress is provided in the portion so that the tension stress is reduced.

SUMMARY

However, it is not known where to form the bead that is effective for a press-formed article having a long linear shape.

It is desirable that one aspect of the present disclosure provide a technology for effectively reducing an amount of the springback.

One aspect of the present disclosure is a manufacturing method for a press-formed article and the manufacturing method comprises: forming a specified shape in a plate-like member made of metal; forming a convex portion in a portion that does not undergo deformation by the forming of the specified shape in the plate-like member; and then later flattening the convex portion.

Such a manufacturing method makes it possible to reduce an amount of springback in the press-formed article, the springback being attributed to the forming of the specified shape in the plate-like member made of metal. Stress that occurs by the forming of the specified shape in the plate-like member may cause the springback in the press-formed article. However, in the aforementioned manufacturing method, the convex portion is formed in the portion that does not undergo the deformation by the forming of the specified shape in the plate-like member, and later, the formed convex portion is flattened. In such a manner, stress, which inhibits the stress that occurs by the forming of the specified shape, occurs in the plate-like member. Accordingly, such an aforementioned manufacturing method makes it possible to reduce the amount of the springback in the press-formed article by adjusting a balance of the stresses that occur in the press-formed article.

In one aspect of the present disclosure, the convex portion may be formed at a position such that the convex portion and a portion where the specified shape is formed are next to each other. In such a manufacturing method, compared with a manufacturing method in which the convex portion is formed at a position such that the convex portion and the portion where the specified shape is formed are not next to each other, it is possible to make it easier to adjust the balance of the stresses that occur in the press-formed article.

In one aspect of the present disclosure, the press-formed article may have a long linear shape. In this case, the convex portion may be formed at a position such that the convex portion and the portion where the specified shape is formed are next to each other along a longitudinal axis of the press-formed article. In such a manufacturing method, compared with a manufacturing method in which the convex portion is formed at a position such that the convex portion and the portion where the specified shape is formed are not next to each other along the longitudinal axis, it is possible to make it easier to adjust the balance of the stresses that occur in the press-formed article.

In one aspect of the present disclosure, the press-formed article may have a long linear shape. In this case, the convex portion may be formed at a position including a portion to be an edge of a width axis orthogonal to the longitudinal axis of the press-formed article and in a shape extending along the width axis from the edge. The convex portion may have a shape with a width that narrows as being farther from the edge. In the press-formed article, as a portion therein is nearer to the edge, the portion is likely to be more affected from stress. Additionally, in the convex portion, as the width thereof is larger, an amount of the stress that occurs by the flattening of the convex portion increases. Accordingly, in the aforementioned manufacturing method, compared with a case of, for example, forming the convex portion whose width is constant, it is possible to makes it easier to adjust the balance of the stresses that occur in the press-formed article.

In one aspect of the present disclosure, the convex portion may have a shape comprising a pointed portion in a triangle-like shape with a width that narrows as being farther from the edge. In such a manufacturing method, compared with a case of a convex portion, for example, in a semi-circular shape, it is possible to make it easier to flatten and planarize a portion that is far from the edge with less power.

In one aspect of the present disclosure, the convex portion may have a shape comprising a portion near the edge, with a width that is constant. In such a manufacturing method, even when a position for forming the convex portion varies to some extent, the constant width is achieved in the portion near the edge of the press-formed article within the convex portion. Accordingly, variation of the effect, which is attributed to the variation in the position where the convex portion is formed, can be inhibited.

In one aspect of the present disclosure, the press-formed article may have a shape that is bent at a specified angle along a bent portion in a linear shape, the bent portion being along the longitudinal axis of the press-formed article. In this case, the convex portion may be formed at a position including a portion to be an edge of each side of the bent portion in the press-formed article. In the press-formed article having the aforementioned shape, a portion near the bent portion is likely to be less affected by the stress and, as a portion is nearer to the edge on each side of the bent portion, the portion is likely to be more affected by the stress. Accordingly, in the aforementioned manufacturing method, compared with a case where the convex portion is formed at a position different from the position including the portion to be the edge on each side of the bent portion in the press-formed article, it is possible to make it easier to adjust the balance of the stresses that occur in the press-formed article.

In one aspect of the present disclosure, the forming of the specified shape and the forming of the convex portion may be performed within a single step, and in a later step, the convex portion may be flattened.

BRIEF DESCRIPTION OF THE DRAWINGS

Hereinafter, an example embodiment of the present disclosure will be described with reference to the accompanying drawings, in which.

DETAILED DESCRIPTION OF THE PREFERRED EMBODIMENTS

1. Configuration of Press-Formed Article

Figure 1:
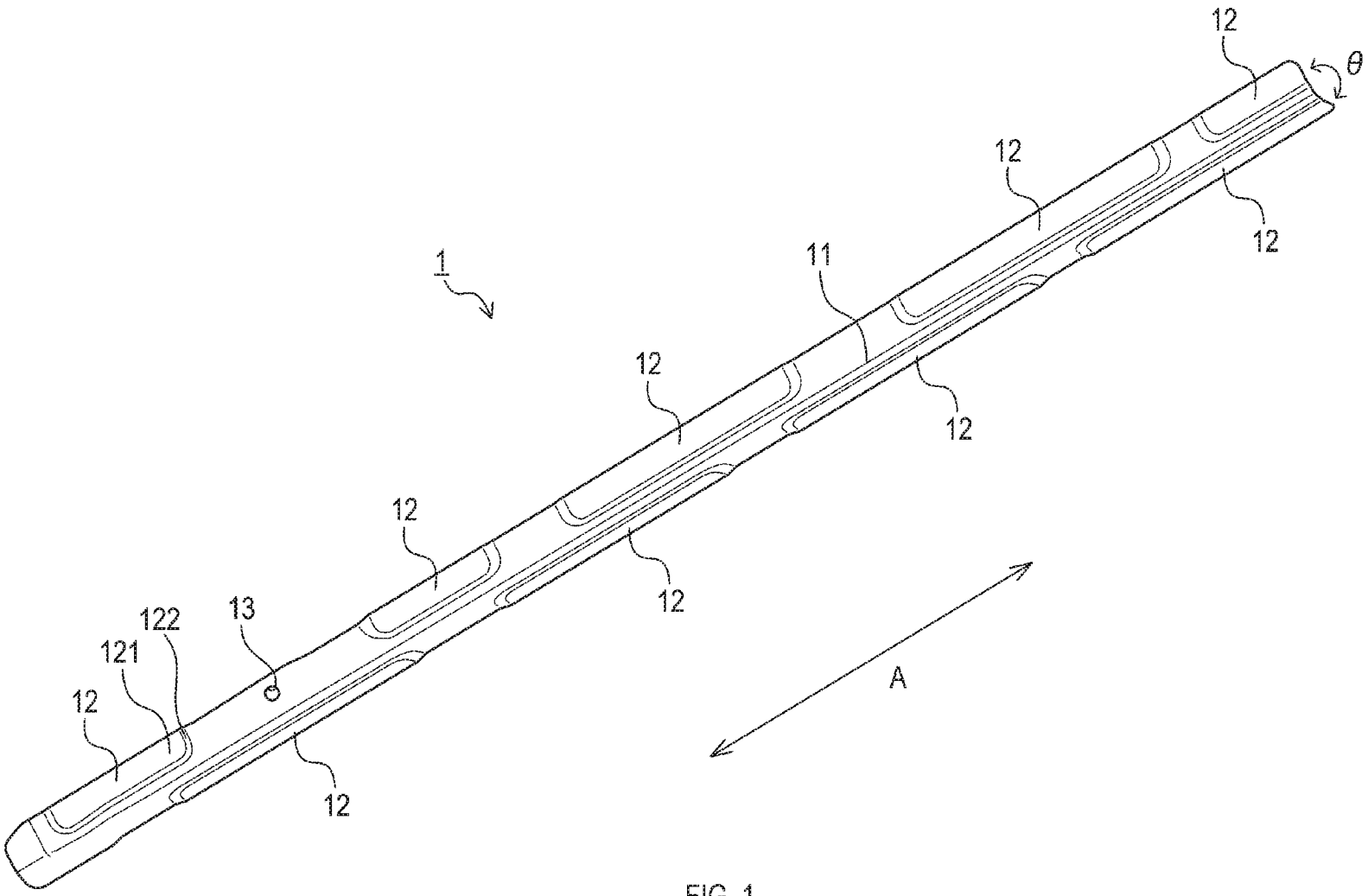
FIG. 1 is a perspective view of a press-formed article.

A press-formed article 1 shown in FIG. 1 is an automobile part made of metal. Specifically, the press-formed article 1 is used for reinforcing a frame part provided on both right and left sides of an automobile. As a material of the press-formed article 1, for example, a steel plate such as a thin steel plate, a surface-treated steel plate, or the like is used.

The press-formed article 1 is a plate-like part in a long linear shape. The press-formed article 1 has a shape that is bent at a specified angle θ ($\theta_{specified}$), for example, at 90 degrees along a bent portion 11 in a linear shape along a longitudinal axis A of the press-formed article 1. That is, a cross-section of the press-formed article 1, which is orthogonal to the longitudinal axis A, is L-shaped. The angle θ ($\theta_{specified}$) is an angle that is specified as a design requirement for a finished article.

The press-formed article 1 comprises stepped portions 12. Each stepped portion 12 is a portion that protrudes or dents with reference to a reference surface that is a surface of a portion where no forming is performed in the press-formed article 1. The stepped portion 12 has a function to increase a rigidity of the press-formed article 1. Also, the stepped portion 12 can serve as a welding surface, for example, where welding such as spot-welding or the like with the frame part is performed. At least one through-hole 13 (see FIG. 1) may be formed in the press-formed article 1.

2. Manufacturing Method

Hereinafter, a manufacturing method for the press-formed article 1 will be described. Included as a manufacturing step of the press-formed article 1 are: a first bending step shown in FIG. 2 and FIG. 3; a second bending step shown in FIG. 4 and FIG. 5; and a third bending step shown in FIG. 6 and FIG. 7.

<Preparation Step>

Figure 8:
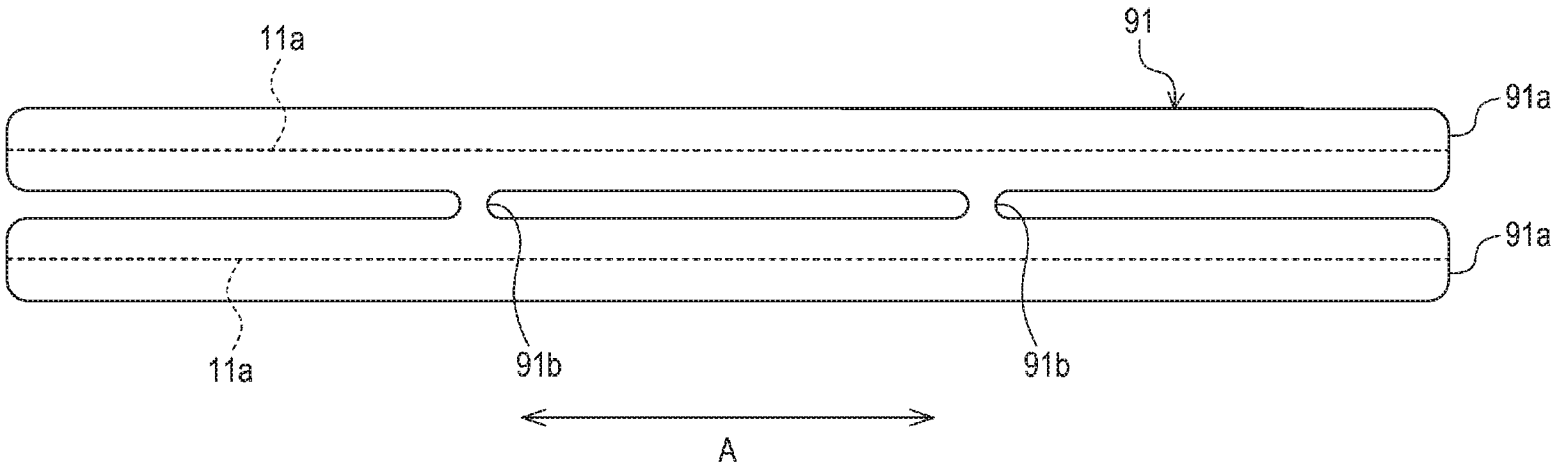
FIG. 8 is a plan view of a plate-like member after trimming.

In a preparation step before the first bending step, trimming is performed to a plate-like member 91 in a flat surface-like shape made of metal so that unnecessary portions are removed therefrom. As shown in FIG. 8, the plate-like member 91 after the trimming has a shape with two belt-like portions 91*a* that are disposed in parallel to and coupled with each other with at least one joining portion 91*b*. The press-formed article 1 is manufactured from each of such two belt-like portions 91*a*. That is, in the present embodiment, the press-formed article 1 finally manufactured from the one plate-like member 91 is two in number. More specifically, such two press-formed articles 1 made from the one plate-like member 91 will be disposed on the right side and the left side of an automobile respectively, and the two press-formed articles 1 may be different to each other in details of shapes thereof.

<First Bending Step>

Figure 2:
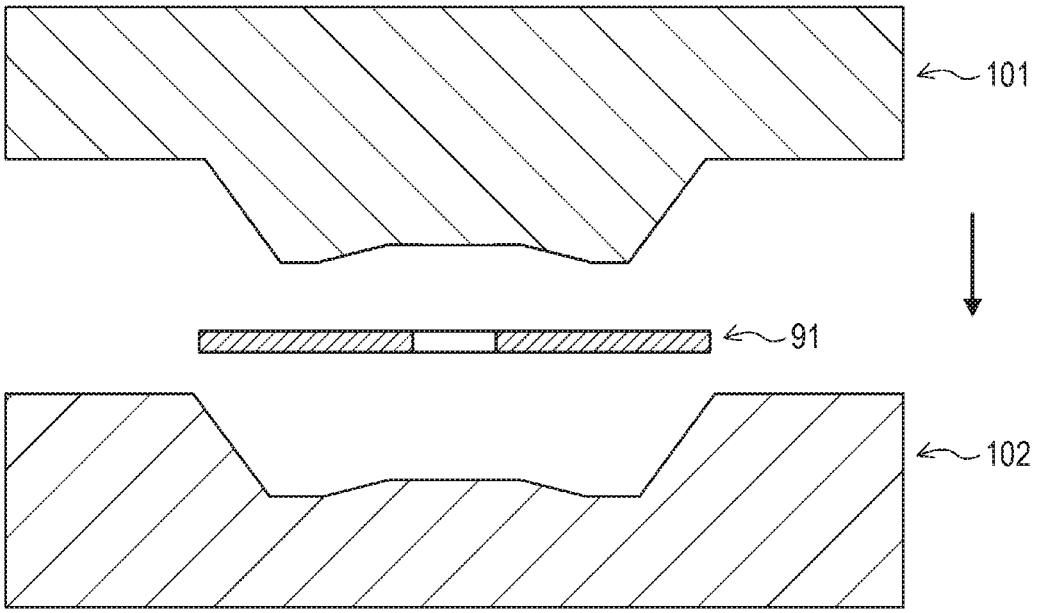
FIG. 2 is a schematic cross-sectional view showing a state before press-forming in a first bending step.
Figure 3:
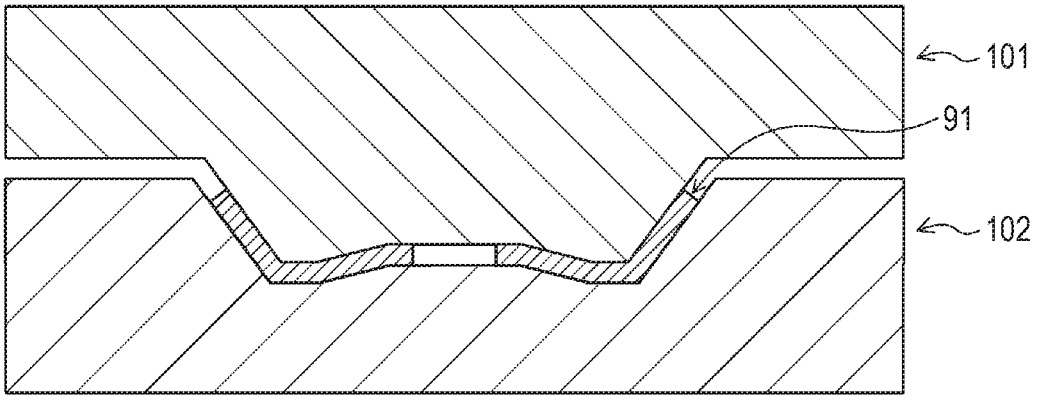
FIG. 3 is a schematic cross-sectional view showing a state after the press-forming in the first bending step.

In the first bending step shown in FIG. 2 and FIG. 3, press-forming is performed to the plate-like member 91 after the trimming, with an upper mold 101 and a lower mold 102. Specifically, in the first bending step, the following processes (1a: First-bending process, 1b: First-forming process, and 1c: Second-forming process, discussed below) are performed to the plate-like member 91 within a single step, in other words, simultaneously. A cross-section of the plate-like member 91 shown in FIG. 3 is a cross-sectional view taken along line of III-III of FIG. 10 that will be described later.

(1a: First-Bending Process)

The first-bending process is a process to bend the plate-like member 91 along two bending lines that are parallel to each other. Each of two portions to be bent in the first-bending process corresponds to the bent portion 11 of the corresponding one of the two press-formed articles 1 manufactured from the plate-like member 91, and the bent portion 11 is shown with a dotted line 11*a* in FIG. 8. The first-bending process is so-called preliminary bending. That is, the plate-like member 91 is not bent fully to the specified angle θ ($\theta_{specified}$) at this stage, and it is bent to a first angle ($\theta_{first}$) larger than the specified angle θ ($\theta_{specified}$).

(1b: First-Forming Process)

Figure 9:
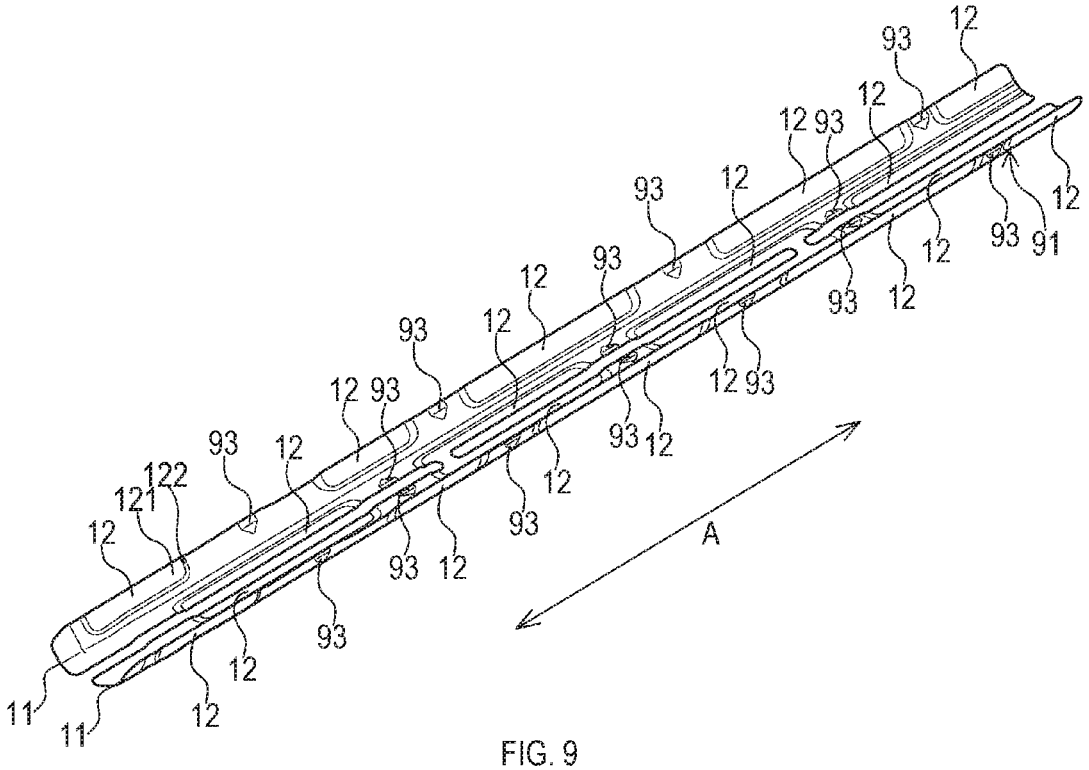
FIG. 9 is a perspective view of the plate-like member in the first bending step after the press-forming.
Figure 10:
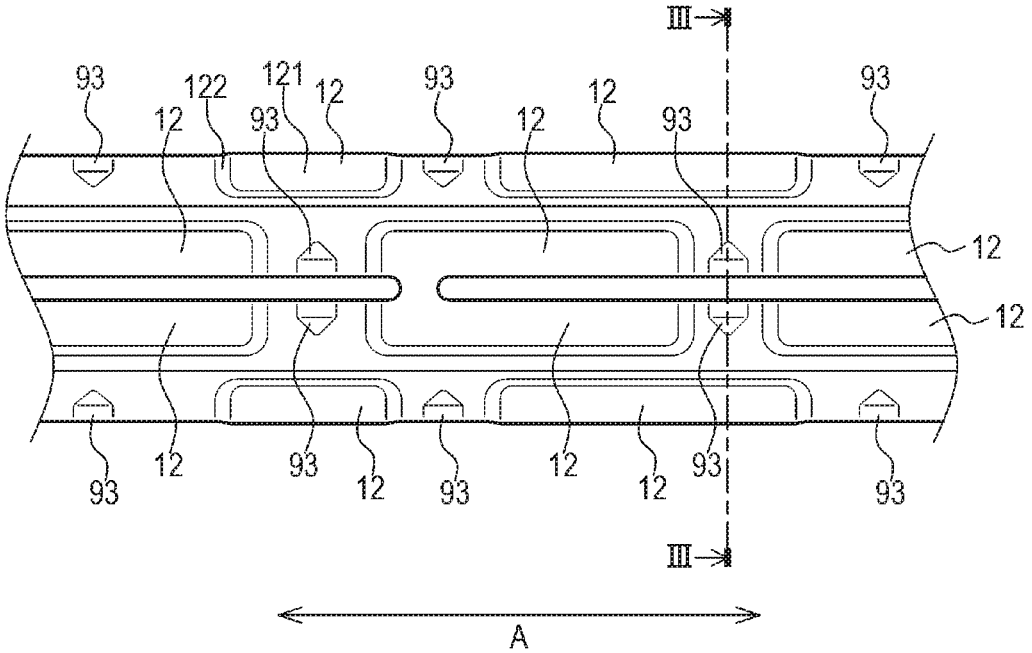
FIG. 10 is a plan view of the plate-like member in the first bending step after the press-forming.

As shown in FIG. 9 and FIG. 10, the first-forming process is a process to form, on flat surfaces in the plate-like member 91, the stepped portions 12 having specified shapes with surface areas that increase from those before the forming. Specifically, each stepped portion 12 comprises: an undeformed surface 121 in a flat surface-like shape at a position protruding on a side of the frame part with reference to a reference surface in the plate-like member 91; and a sloping surface 122 surrounding an outer circumference of the undeformed surface 121. Within the stepped portion 12, the undeformed surface 121 is a portion that does not undergo deformation in the first-forming process, and the sloping surface 122 is a portion that undergoes deformation in the first-forming process. The portion that undergoes the deformation by the forming indicates a portion where tension deformation or compression deformation partially occurs by the forming. The undeformed surface 121 has a shape whose length along the longitudinal axis A is larger than a width thereof, which is orthogonal to the longitudinal axis A. In the present embodiment, the stepped portion 12 is formed at a position including a portion to be an edge at an end of a width axis orthogonal to the longitudinal axis A in the plate-like member 91. When the stepped portion 12 is formed, stress occurs in the plate-like member 91. Such stress may become a factor for springback that is deformation like warpage of the plate-like member 91.

(1c: Second-Forming Process)

Figure 11:
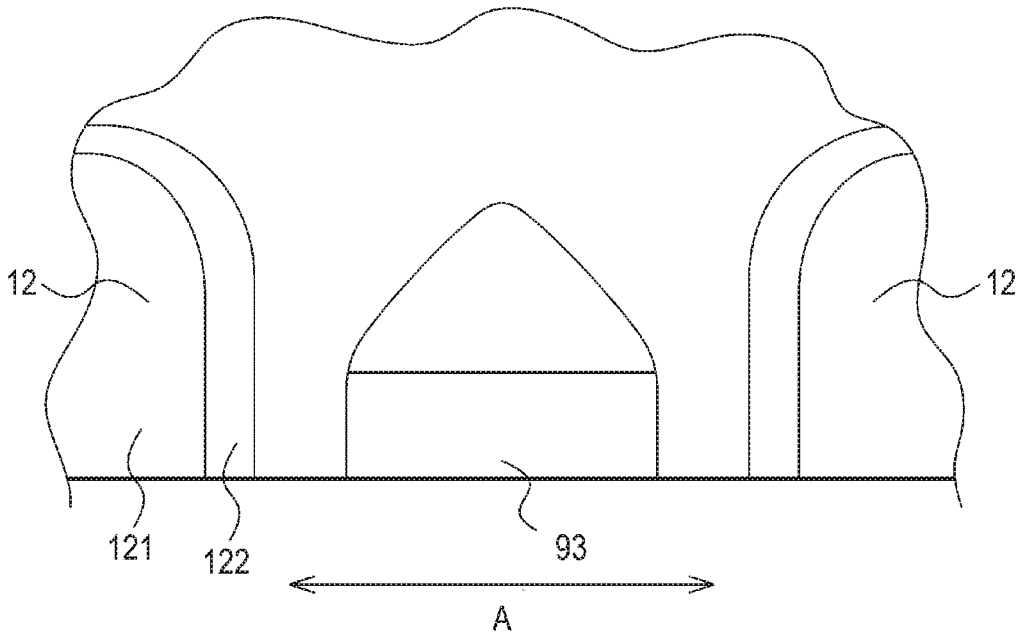
FIG. 11 is a plan view of a convex portion.
Figure 12:
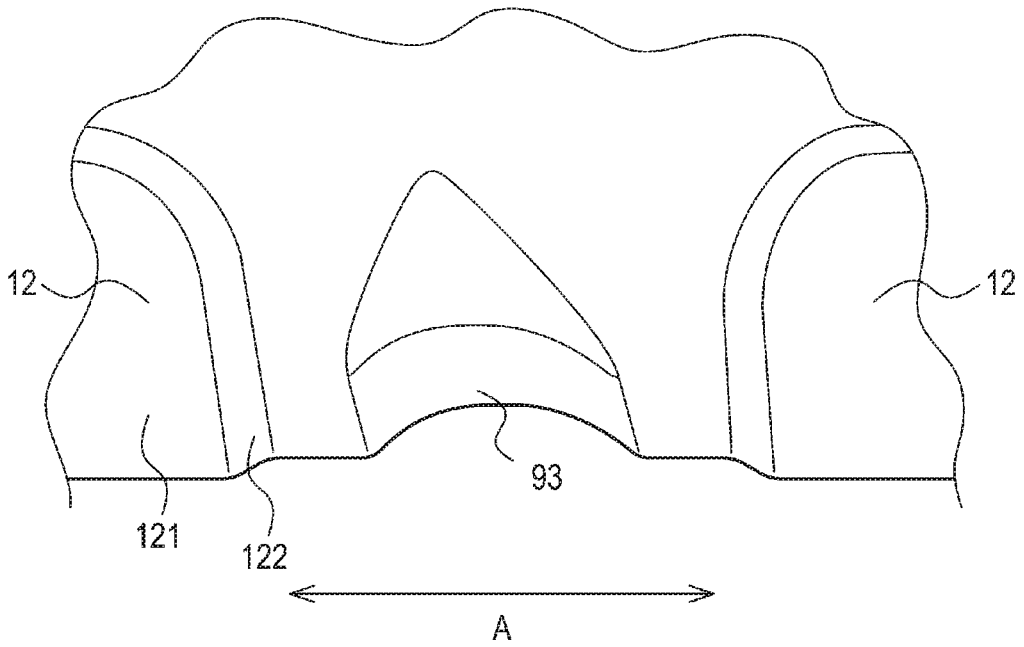
FIG. 12 is a perspective view of the convex portion.

The second-forming process is a process to form convex portions 93 in portions consisting of flat surfaces in the plate-like member 91, where no deformation occurs by the forming of the stepped portions 12, for example in this embodiment, where the stepped portions 12 are not formed. Each convex portion 93 is a portion in which, out of both sides of each flat surface in the plate-like member 91, a first surface dents by force applied thereon and a second surface protrudes. In the present embodiment, the convex portion 93 is a so-called bead. The convex portion 93 is formed at a position such that the convex portion 93 and a portion where the stepped portion 12 is formed are next to each other along the longitudinal axis A. Specifically, the convex portion 93 is formed at a position including a portion to be an edge of the width axis orthogonal to the longitudinal axis A of the press-formed article 1 and in a shape extending along the width axis from the edge. In other words, the convex portion 93 is formed at a position including a portion to be an edge on each side of the bent portion 11 in the press-formed article 1. As shown in FIG. 11, the convex portion 93 in plan view, in other words, if viewed from a position orthogonal to a plane of the flat surface in the plate-like member 91, has a shape comprising a pointed portion in a triangle-like shape whose width narrows as being farther from an edge of the press-formed article 1, in other words, as being closer to the bent portion 11. The convex portion 93 has a shape comprising a portion near the edge of the press-formed article 1, with a width that is constant. As shown in FIG. 12, the convex portion 93 protrudes in a curved surface-like shape, specifically, in a conical surface-like shape with respect to the reference surface in the plate-like member 91. The convex portion 93 protrudes on an opposite side of the side of the frame part, that is, in a direction opposite as that of the stepped portion 12.

<Second Bending Step>

Figure 4:
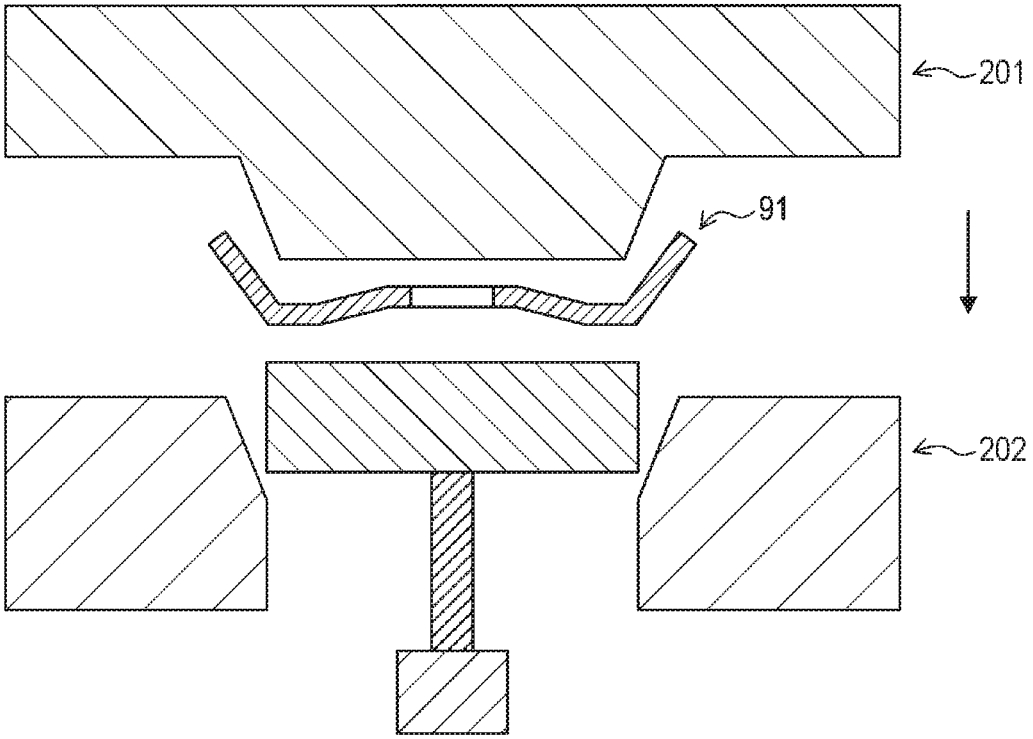
FIG. 4 is a schematic cross-sectional view showing a state before press-forming in a second bending step.
Figure 5:
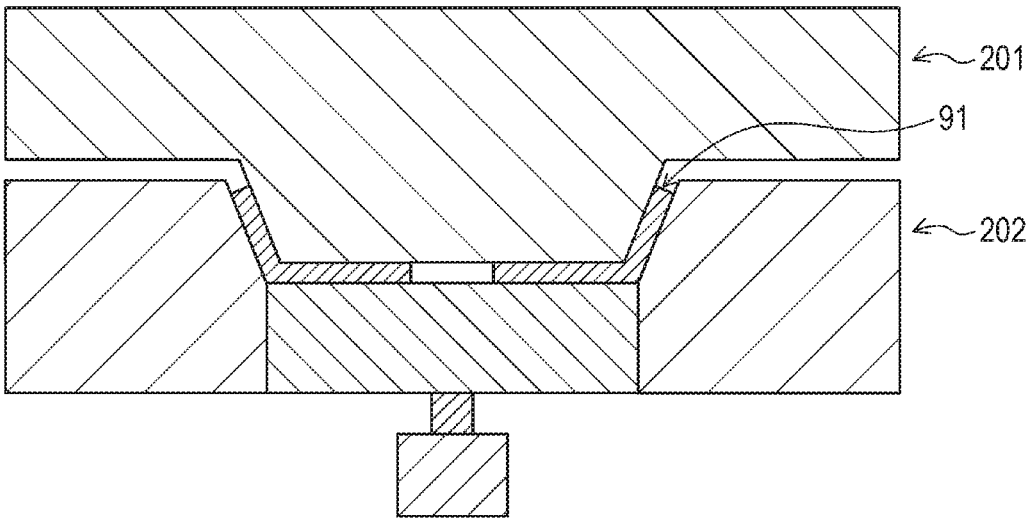
FIG. 5 is a schematic cross-sectional view showing a state after the press-forming in the second bending step.

In the second bending step shown in FIG. 4 and FIG. 5, press-forming is performed to the plate-like member 91 after the first bending step, with an upper mold 201 and a lower mold 202. Specifically, in the second bending step, the following processes (2a: Second-bending process and 2b: Third-forming process, discussed below) are performed to the plate-like member 91 within a single step, in other words, simultaneously.

(2a: Second-bending process)

The second-bending process is a process to bend the portion that was bent in the plate-like member 91 in the first-bending process, that is, the portion corresponding to the bent portion 11 of the press-formed article 1, which is shown with the dotted line 11*a* in FIG. 8. In the second-bending process, the plate-like member 91 is bent to a second angle ($\theta_{second}$) closer to the specified angle θ ($\theta_{specified}$) than the first angle ($\theta_{first}$) in the first-bending process. In other words, the $\theta_{first}$>the $\theta_{second}$>the $\theta_{specified}$.

(2b: Third-Forming Process)

The third forming process is a process to flatten all of the convex portions 93 formed in the second-forming process. In the plate-like member 91, stress occurs by the flattening of the convex portions 93 and such stress inhibits the stress occurred in the first-forming process by the forming of the stepped portions 12. Consequently, a balance of the stresses that occur in the plate-like member 91 is adjusted. The flattening of the convex portions 93 herein refers to forming of the convex portions 93 to have shapes that are similar to the flat surfaces before the convex portions 93 were formed.

<Third Bending Step>

Figure 6:
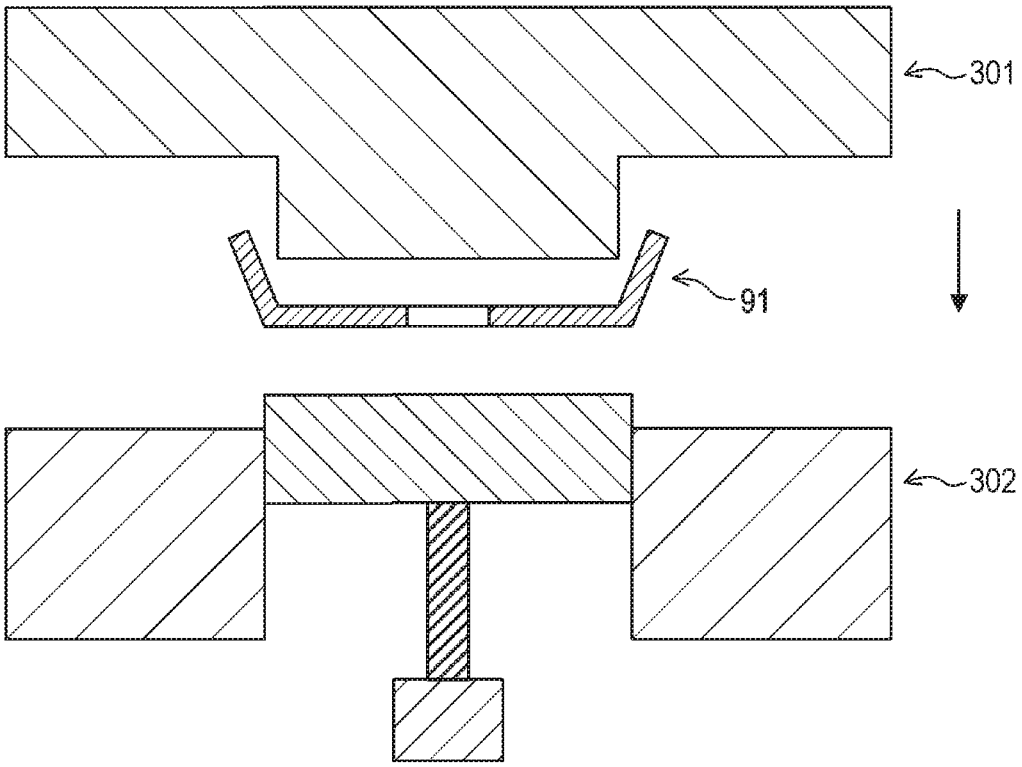
FIG. 6 is a schematic cross-sectional view showing a state before press-forming in a third bending step.
Figure 7:
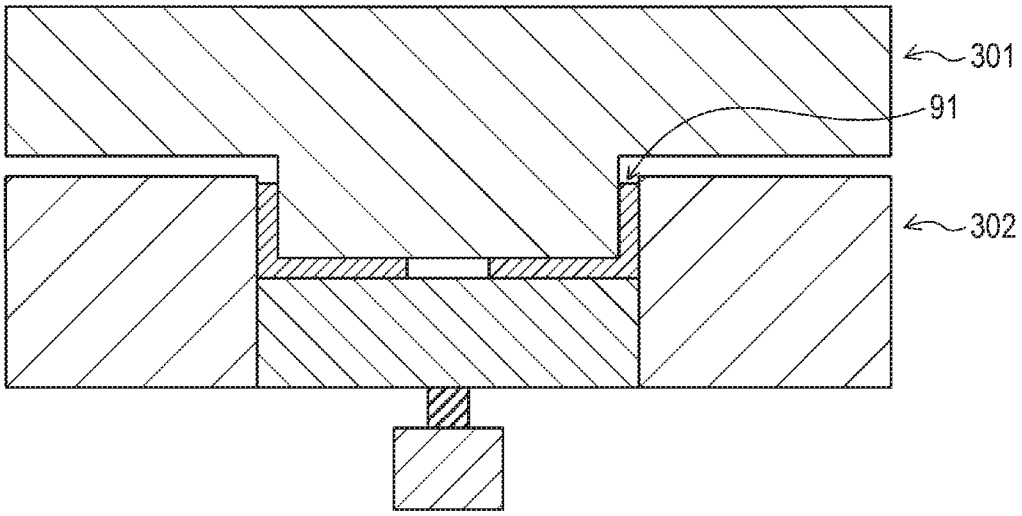
FIG. 7 is a schematic cross-sectional view showing a state after the press-forming in the third bending step.

In the third bending step shown in FIG. 6 and FIG. 7, press-forming is performed to the plate-like member 91 after the second bending step, with an upper mold 301 and a lower mold 302. Specifically, in the third bending step, the following process (3a: Third-bending process) is performed to the plate-like member 91.

(3a: Third-Bending Process)

The third-bending process is a process to bend the portion that was bent in the plate-like member 91 in the second-bending process, that is, the portion corresponding to the bent portion 11 of the press-formed article 1, which is shown with the dotted line 11*a* in FIG. 8. In the third-bending process, the plate-like member 91 is bent to the specified angle θ ($\theta_{specified}$).

<Finishing Step>

After the third bending step, processes including cutting of the joining portions 91*b* of the plate-like member 91 are performed so that the two press-formed articles 1 are finished. These two articles may be mirror images, or may be substantially different.

3. Effects

According to details of the embodiment that has been described, the following effects can be obtained.

(1) The manufacturing method of the press-formed article 1 comprises: the forming of the stepped portion 12 in the plate-like member 91; the forming of the convex portion 93 in the portion where no deformation occurs by the forming of the stepped portion 12 in the plate-like member 91; and the flattening of the convex portion 93.

Such a manufacturing method makes it possible to reduce an amount of the springback in the press-formed article 1, the springback being attributed to the forming of the stepped portion 12 in the plate-like member 91. That is, the stress that occurs by the forming of the stepped portion 12 in the plate-like member 91 may become the factor for the springback in the press-formed article 1 and the warpage along the longitudinal axis A may occur. However, in the manufacturing method of the present embodiment, the convex portion 93 is formed in the portion where no deformation occurs by the forming of the stepped portion 12 in the plate-like member 91 and then, the formed convex portion 93 is flattened. This leads to occurrence of the stress that inhibits the stress occurred by the forming of the stepped portion 12 in the plate-like member 91. Accordingly, in the aforementioned manufacturing method, the balance of the stresses that occur in the press-formed article 1 is adjusted so that the amount of the springback in the press-formed article 1 can be reduced.

(2) The convex portion 93 is formed at the position such that the convex portion 93 and the portion where the stepped portion 12 is formed are next to each other (and alternate with each other in the longitudinal axis). Accordingly, compared with a manufacturing method in which the convex portion 93 is formed at a position such that the convex portion 93 and the portion where the stepped portion 12 is formed are not next to each other, it is possible to make it easier to adjust the balance of the stresses that occur in the press-formed article 1.

(3) The convex portion 93 is formed at the position such that the convex portion 93 and the portion where the stepped portion 12 is formed are next to each other (in an alternating fashion) along the longitudinal axis A. Accordingly, compared with a manufacturing method in which the convex portion 93 is formed at the position such that the convex portion 93 and the portion where the stepped portion 12 is formed are not next to each other along the longitudinal axis A, it is possible to make it easier to adjust the balance of the stresses that occur in the press-formed article 1.

(4) The convex portion 93 is formed at the position including the portion to be the edge of the width axis orthogonal to the longitudinal axis A of the press-formed article 1 and in the shape extending along the width axis from the edge. The width of the convex portion 93 narrows as being farther from the edge of the press-formed article 1. In the press-formed article 1, as a portion therein is nearer to the edge, the portion is likely to be more affected from stress. Additionally, in the convex portion 93, as the width thereof is larger, an amount of the stress that occurs by the flattening of the convex portion 93 increases. Accordingly, compared with a case of forming the convex portion whose width is, for example, constant, it is possible to make it easier to adjust the balance of the stresses that occur in the press-formed article. Further, compared with a case of forming the convex portion, for example, in a circular shape at a position that does not include the portion to be the edge in the press-formed article, it is possible to make it easier to perform the flattening and planarizing with less power.

(5) The convex portion 93 comprises the pointed portion in the triangle-like shape (including a conical shape) with the width that narrows as being farther from the edge of the press-formed article 1. Accordingly, compared with a case where the convex portion is formed in a circular shape, for example, it is possible to make it easier to flatten and planarize a portion that is far from the edge with less power.

(6) The convex portion 93 has the shape comprising the portion near the edge, with the constant width. Thus, even when a position for forming the convex portion 93 varies to some extent, the constant width is achieved in the portion near the edge of the press-formed article 1 within the convex portion 93. Accordingly, even when the position for forming the convex portion 93 varies, a constant effect of stress alleviation can be obtained around the edge and thus, variation in the effect, which is attributed to processing accuracy, can be inhibited.

(7) The convex portion 93 is formed at the position including the portion to be the edge on each side of the bent portion 11 in the press-formed article 1. In the press-formed article 1 having the aforementioned shape, a portion near the bent portion 11 is likely to be less affected by the stress. In contrast, as a portion is nearer to the edge on each side of the bent portion 11, the portion is likely to be more affected by the stress. Accordingly, compared with a case where the convex portion 93 is formed at a position different from the position including the portion to be the edge on each side of the bent portion 11 in the press-formed article 1, it is possible to make it easier to adjust the balance of the stresses that occur in the press-formed article 1.

(8) In the second-forming process, the convex portion 93 is formed so as to protrude on the opposite side of the side of the frame part. Accordingly, this can make it possible that, when the press-formed article 1 is mounted to the frame part by welding, the convex portion 93, more precisely, the convex portion 93 that was flattened in the third-forming process, is less likely to affect the welding.

4. Other Embodiments

The embodiment of the present disclosure has been described above. However, the present disclosure is not limited by the aforementioned embodiment, and can be practiced in various manners.

(1) In the aforementioned embodiment, described is the manufacturing method where the forming of the stepped portion 12 and the forming of the convex portion 93 are performed in the single step, and in the following step, the convex portion 93 is flattened. However, the forming order is not limited to such an order described in the aforementioned embodiment. For example, the convex portion 93 may be formed in a step before a step where the stepped portion 12 is formed. In such a case, the flattening of the convex portion 93 can be performed in any one of the following steps: a step before; in the same step as; or in a step after, the step where the stepped portion 12 is formed. Also, for example, the convex portion 93 may be formed in a step after the step where the stepped portion 12 is formed, and in the following step, the convex portion 93 may be flattened.

(2) The position for forming the convex portion is not limited to the position in the plate-like member 91 such that the convex portion and the portion where the stepped portion 12 is formed are next to each other along the longitudinal axis A. For example, the position for forming the convex portion 93 may be on the undeformed surface 121, which is the portion that does not undergo the deformation in the first-forming process within the stepped portion 12.

(3) The shape of the portion, which is formed in the first-forming process, is not limited to that of the stepped portion 12 and other shape may be taken.

(4) The material of the press-formed article 1 is not limited to the steel plate. For example, a stainless steel plate, an aluminum alloy, or the like may be used.

(5) In the aforementioned embodiment, described is the press-formed article 1 used for reinforcing the frame part provided on both right and left sides of an automobile. However, the press-formed article is not limited to this. For example, the press-formed article may be used as other automobile part or as other part than the automobile part.

(6) Functions of one constituent element in the aforementioned embodiments may be divided and separately performed by a plurality of constituent elements, or functions of a plurality of constituent elements may be integrated and performed by one constituent element. Part of the configuration in the aforementioned embodiments may be omitted. At least part of the configuration in the aforementioned embodiments may be added to or replaced by the configuration in the aforementioned other embodiments. Any modes included in the technical ideas specified by the languages of the claims are embodiments of the present disclosure.

What is claimed is:

1. A manufacturing method for a press-formed article, the manufacturing method comprising:

forming a specified shape in a portion of a flat member made of metal to form a workpiece, the specified shape having a plurality of stepped portions that protrude from a reference surface of the workpiece and are positioned at an edge of the workpiece parallel to a longitudinal axis of the workpiece, wherein the reference surface is a surface portion of the workpiece in which no forming is performed;

forming a plurality of convex portions in portions of the workpiece that do not undergo deformation by the forming of the specified shape, wherein the convex portions and the stepped portions are positioned to alternate with one another in a direction parallel to the longitudinal axis of the workpiece; and flattening the plurality of convex portions of the workpiece without flattening the plurality of stepped portions to yield the press-formed article;

wherein the press-formed article has an elongated linear shape.

2. The manufacturing method for the press-formed article according to claim 1, wherein each convex portion is formed at a position including a portion to be at the edge, each convex portion being formed in a shape extending along the width axis from the edge, and having a shape with a width that narrows as being farther from the edge.

3. The manufacturing method for the press-formed article according to claim 2, wherein each convex portion has a shape comprising a pointed portion in a triangular shape with a width that narrows as being farther from the edge.

4. The manufacturing method for the press-formed article according to claim 3, wherein each convex portion has a shape comprising a portion near the edge, with a width that is constant.

5. The manufacturing method for the press-formed article according to claim 1, wherein the forming of the specified shape and the forming of the plurality of convex portions are performed within a single step, and in a later step, the flattening of the plurality of convex portions is performed.

* * * * *